US005384593A

United States Patent [19]

Gell, Jr. et al.

[11] Patent Number: 5,384,593

[45] Date of Patent: Jan. 24, 1995

[54] METHOD AND APPARATUS FOR REFLEX BLINK REACTION CONDITIONING

[76] Inventors: Harold A. Gell, Jr., 13720 Lockdale Rd., Silver Spring, Md. 20906-2117; Constantine Haralambopoulos, 709 English Rd., Rochester, N.Y. 14616

[21] Appl. No.: 241,634

[22] Filed: May 12, 1994

Related U.S. Application Data

[63] Continuation-in-part of Ser. No. 102,224, Aug. 5, 1993, Pat. No. 5,333,009.

[51] Int. Cl.[6] ..... A61H 1/02

[52] U.S. Cl. ..... 348/61; 345/112; 601/37

[58] Field of Search ..... 348/61, 578, 62; 345/112; 601/37

[56] References Cited

U.S. PATENT DOCUMENTS

| | | | |
|---|---|---|---|
| 3,923,044 | 12/1975 | Miller | 128/25 |
| 4,294,522 | 10/1981 | Jacobs | 601/37 |
| 4,952,024 | 8/1990 | Gale | 348/53 |
| 5,051,931 | 9/1991 | Cheu et al. | 364/550 |
| 5,099,829 | 3/1992 | Wu | 128/32 |

*Primary Examiner*—Tommy P. Chin

*Assistant Examiner*—A. Au

*Attorney, Agent, or Firm*—Harold Gell

[57] ABSTRACT

A method and apparatus for conditioning a blink reaction of a person using a computer terminal display. Blinking is selectively triggered by a macro shift in the dominant object viewed by the person or a macro tactile event simultaneously with a shift in a non-dominant object viewed by the person or a micro tactile event. The macro shift may be in the form of foreground-/background reversal, display color changes, blank screen, etc. caused by hardware switching device or programed ANSI escape sequence changes. The non-dominant object may be a cursor, the last character typed, etc. The macro or micro tactile event may be a vibration, sound, puff of air, etc. The person is conditioned to blink in response to the non-dominant visual cue or micro tactile event by the association between the non-dominant or micro event and the dominant or macro event which causes involuntary blinking. As the persons conditioning develops, the intensity of the dominant or macro event is decreased until the force causing involuntary blinking shifts completely to the non-dominant or micro event, after which the dominant or macro event is discontinued.

79 Claims, 3 Drawing Sheets

METHOD AND APPARATUS FOR REFLEX BLINK REACTION CONDITIONING

RELATED U.S. PATENT DATA

This is a continuation-in-part of U.S. patent application Ser. No. 08/102,224, filed Aug. 5, 1993, allowed Mar. 3, 1994 and now U.S. Pat. No. 5,333,009.

FIELD OF THE INVENTION

A system for conditioning a computer terminal operator to blink in response to a minor visual or tactile cue.

BACKGROUND OF THE INVENTION

The ever increasing use of computer terminals in the work place and as a means for entertainment has resulted in a corresponding increase in asthenopia, i.e. eyestrain, eye irritation, and general eye discomfort in computer users generally related to "dry eye". Many attempts have been made to solve this problem. The attempts include the use of non-glare screens and various color combinations of the display. All of these attempts have failed.

Recent exhaustive studies by the medical profession have resulted in a breakthrough with respect to understanding the problem. Medical investigators have determined that a computer user staring at a display terminal blinks at a rate which is significantly below the norm for that individual. This reduction in the rate at which a person blinks causes a corresponding reduction in the frequency at which the eye is cleansed and bathed by secretions from the tear duct. This leads to a dry eye syndrome manifested as discomfort, irritation and fatigue. In extreme cases, the irritation can lead to more serious problems affecting the health of the eyes.

One factor leading to the reduced blink syndrome is that a video display terminal changes on a micro level as single letters or numbers are added to the screen by an operator. This creates a gradual or micro change to the visual field which will not stimulate a blink response. What is required to cause reactive blinking is a sudden change in the visual field on a macro level such as might be caused by a strobe light.

The co-pending patent application, Ser. No. 08/102,224, of the present inventors teaches the use of involuntary blink reactions caused by macro events to reduce eye strain. That approach has proved satisfactory for most computer terminal operators, but for others using a computer for purposes requiring deep concentration, the macro events, even when subliminal, are an unacceptable distraction.

OBJECTIVES OF THE INVENTION

It is a primary objective of the present invention to condition a computer display terminal user's automatic blink reflex to respond to micro events.

Another objective of the invention is to provide macro events for triggering an operators involuntary blink reflex synchronously with micro events to condition the operator to respond with an involuntary blink response to said micro events.

It is a further objective of the present invention to condition a computer display terminal user to blink at a predetermined rate as an involuntary blink reflex response to looking at a computer display screen.

It is an objective of the present invention to provide a means to trigger a computer display terminal user's automatic blink reflex.

Another objective of the present invention is to provide a means to control the rate at which a computer terminal user blinks.

A still further objective of the present invention is to provide a visual stimulus for a computer terminal user which will create a reflex blink reaction in the terminal user.

A still further objective of the present invention is to provide a means for controlling a stimulus created in association with a computer display terminal which will cause the automatic blink of a user's eye.

Another objective of the invention is to provide an embedded program which will periodically alter the ANSI escape sequence affecting the terminal display characteristics.

A still further objective of the invention is to provide an adjustable switching means for periodically causing reversal of the video in a terminal display.

Another objective is to provide a means for changing the display screen attributes to effect a periodic macro shift in the image presented by the display.

A further objective is to provide a switching means for periodically switching a video display from standard to reverse or visa versa.

Another objective of the invention is to provide an embedded program which will periodically alter the ANSI escape sequence affecting the cursor characteristics.

A still further objective of the invention is to provide a means for periodically causing a momentary reversal of the video of a just typed character on a terminal display.

Another objective is to provide a means for periodically causing a brief period of blinking of a just typed character on a terminal display.

SUMMARY OF THE INVENTION

The present invention provides a method and apparatus for reducing eyestrain and eye irritation resulting from prolonged use of a computer terminal visual display and the attendant blink rate reduction by conditioning the terminal operator to blink in response to a minor cue. The display user is caused to blink at a controlled rate which in a preferred embodiment approximates the normal blinking rate for the individual by manipulation of the visual impact of the computer display on the user, i.e. a reflex blinking reaction is triggered by variations in the visual display being used by the subject. These variations may include one or more of the following: video reversal, contrast shifts, illumination intensity shifts, format shifts, and/or subject matter shifts. These shifts are all of a visually discernible nature but may be presented for a duration which is sub-audible. In addition to the visual stimulus contemplated by this invention, it is contemplated that the blinking reflex may be instigated by pressure fronts created in the form of a blast of air or a sonic front generated by a sub-audible tone of a very brief and sharp nature. The proceeding are considered macro events and as such are capable of inducing an involuntary blink response whenever they occur.

A micro event is generated synchronously with each macro event until the operator associates the involuntary blink response to the macro event with the micro event. Once this relationship is established, the macro events are discontinued and the controlled blinking is maintained by only the micro event cues. Ultimately the micro event cues become unnecessary and the controlled rate blink response is triggered by a completely conditioned operator looking at an active terminal display screen. The micro events may be the cursor with it's blink rate synchronized to the macro events or it's brightness increased periodically to correspond to the macro events; a brief video reversal or intensity flare or blink sequence of a just typed character; a mild vibration of the keyboard or other item the operator is in contact with; a slight puff of air; a sub-audible pressure wave; or a sound.

DETAILED DESCRIPTION OF THE INVENTION

Figure 1:
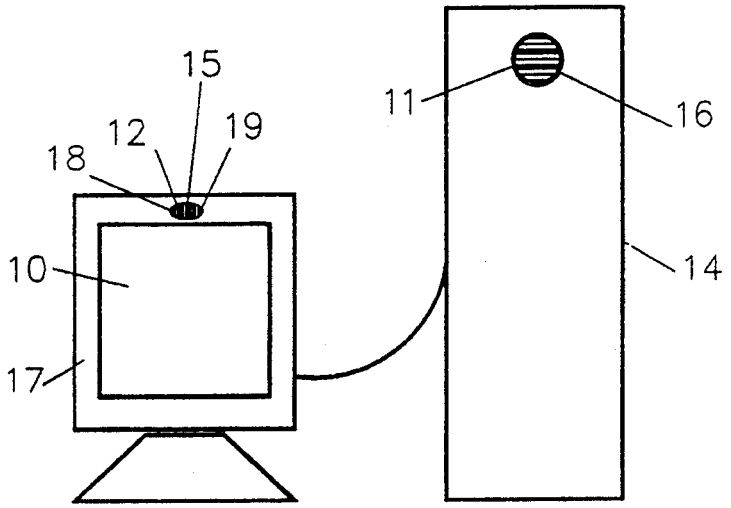
FIG. 1 illustrates a typical computer terminal.

In a conventional computer terminal such as illustrated in FIG. 1, a visual display means 10 provides graphic information that the operator constantly views while operating the terminal. The constant viewing causes a relative immobilization of the eye so that it does not experience the normal relative movement with respect to the eyelids and tear ducts. The image field remains relatively constant and unchanging except for micro changes resulting from adding letters and numbers to the screen one at a time. These micro changes in the image field do not induce reactive blinking which further diminishes the amount of relative movement between eyelids and the eye thus leading to drying of the eye and discomfort and other physical problems as previously discussed. However, this invention provides a means to condition an operator to blink in an involuntary reflex reaction in response to selected micro changes or stimuli.

In various embodiments of the invention, a visual change or tactile event is repeatedly created at a magnitude great enough to cause the involuntary blink reaction of an operator of a display terminal. Changes or events of a magnitude to cause this involuntary blink response without prior conditioning are referred to herein as macro changes or events.

In some embodiments of the invention relying on a visual change, an operation of the screen 10 is altered to effect a macro change in the visual presentation, i.e. the operator's field of view. This change is of short duration so as not to interfere with operation of the terminal and it is repeated at a rate which is adjustable and which may approximate the normal blink rate of an individual not under the duress of staring at a computer display screen. The brief, repetitive macro image changes may be of a duration which is barely discernible or the period of change may be subliminal so as not to affect the operator's function at the computer workstation.

A micro stimulus is synchronized with the macro change or event to function as a cue in response to which an operator will become conditioned to blink. The macro change or event and micro stimulus may be visual or tactile or a combination thereof. The micro stimulus may be any one of the macro changes or events created at a reduced intensity or duration.

In a preferred embodiment, a blink inducing macro change to the display is achieved via the computer operating system. For purposes of explanation, assume the computer is running under MS-DOS. A time dependent repeating program is embedded in the program being run using any of the well known programming techniques whereby the screen attributes are periodically switched by an ANSI escape sequence. In this embodiment, assume that the system default is white text or foreground with a black background. An embedded command, ESC[7m, changes the display from the default to black text on a white background. After an interval which may be so short that the change is not apparent to the user (subliminal), a command of ESC[0m is given to switch the display back to the default mode. The timing between the ESC[7m and following ESC[0m sequence is controlled by a timing routine which is selected to be most compatible with the primary program or programming language being used. For consistency, the time between non-standard and return to default video commands is referred to as the "blink duration". The two escape sequences, blink duration, are repeated at a rate, herein after referred to as "blink rate", which may be based on the system clock or other internal timing functions. A primary criterion for selecting a timing routine for both the blink duration and blink rate is that the periods are controllable.

A micro stimulus may be generated synchronously with the above described macro change by pairing additional commands with each of the macro change inducing commands. The additional commands should be selected from escape commands which will cause a micro stimulus, such as changing the cursor style, temporarily reversing the video, changing the color or increasing the brightness to a flair extent of characters typed during the stimulus interval. As an operator becomes conditioned to the micro stimulus, the frequency of the macro changes are decreased without affecting the frequency of the micro stimulus and eventually discontinuing the macro changes.

If the automatic repetitive blink stimulating operation of the forgoing embodiment is unacceptable in a work environment, an alternate embodiment may be implemented which allows a terminal operator to activate a blink stimulation whenever desired. In this embodiment, a key from the keyboard which is not normally used is programed to activate a blink duration. So instead of combining the blink duration sequence with a blink rate command, the blink duration is combined with a key assignment. Thus every time the operator depresses the assigned key, a blink duration sequence occurs. The sequence can be altered to include macro and micro events or a combination thereof as described for the preferred embodiment.

The macro change to the field of view may manifest itself by any one of a variety of means. The previous two embodiments use reverse video or image reversible by implementing the reverse video ANSI command 7m and return to default command 0m. This combination of attribute shifts is primarily for a monochrome monitor. If a color monitor is being used, other screen attribute changes may be used to cause macro shifts in the field of view. By way of example, the following is a listing of ANSI screen attribute codes and related colors for foreground and background that may be combined to create macro shifts to the field of view, i.e. the display screen and micro stimulus cues.

The following attributes specify text or foreground color:

30 Black
31 Red
32 Green
33 Yellow
34 Blue
35 Magenta
36 Cyan
37 White
7 Black text on a white background The following attributes specify background color:

40 Black
41 Red
42 Green
43 Yellow
44 Blue
45 Magenta
46 Cyan
47 White
7 Black text on a white background In the forgoing embodiments, the blink duration and if applicable the blink rate are adjusted by program manipulation, the specific type of which is dependent on the program in which the screen attribute change commands are embedded.

Figure 2:
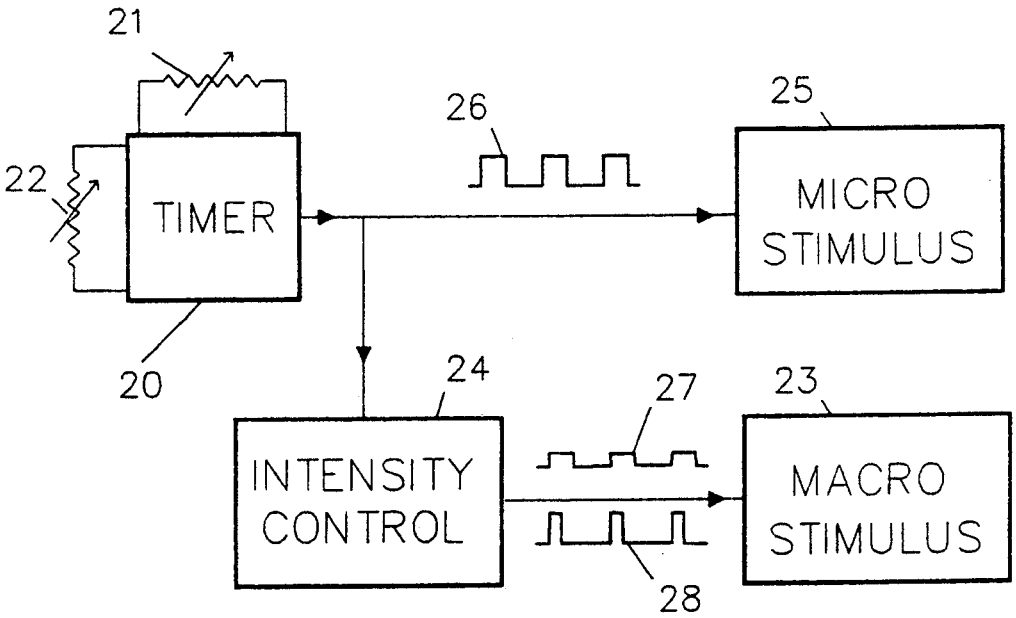
FIG. 2 is a simplified block diagram illustrating a means to control the blink inducing stimulus.

In addition to creating macro field of view shifts via programming, the same effect can be obtained by manipulating the image reversal switch found on most computer monitors. In this form of the invention, the reverse video switch of the monitor is paralleled by or replaced by an electronic switch driven by a timer as illustrated in FIG. 2. The timer 20 produces a pulse train 26 in which the pulse width and repetition rate are controlled by separate potentiometers 21 and 22 or by electronic delay or counting means. The pulse width produces the blink duration and the pulse repetition rate is the blink rate. An intensity control 24 regulates the amplitude and/or pulse width of the pulse train applied to the macro stimulus means 23 to permit that stimulus to be reduced in effect without altering the operation of the micro stimulus means 25. For instance, the intensity control device 24 can reduce the amplitude of the pulses of pulse train 26 to produce pulse train 27 to decrease the output of the macro stimulus means 23. Alternatively, the intensity control device 24 can reduce the width of the pulses comprising pulse train 26 to produce pulse train 28 to decrease the output of the macro stimulus means 23.

In cases where a monitor is designed without a video reversal circuit, one is added. In the later case, pulsed operation may be designed into the circuit or added as a control input. In these forms of the invention, the code sequence commanding the micro stimulus cues must be synchronized with the video reversal of the monitor. Alternately, a micro stimulus cue not associated with the display screen may be activated by the same command or pulse train used to activate the macro function as illustrated in FIG. 2.

In an alternate embodiment, the macro shift in the field of view is created by defocusing the image on the display means. In this embodiment, the defocusing must be at such a great magnitude that the overall effect is a macro shift in the image as viewed by the observer. This is achieved by a timing circuit as illustrated in FIG. 2 but instead of a video polarity or attribute control means, means 23 represents the focus control circuit. In this embodiment, each time a pulse from the timer 20 is applied to the focus control means the focus voltage level is changed by an amount sufficient to defocus the foreground images on the monitor to the extent that the area of foreground imagery increases to the extent that it constitutes a macro change in the display.

In another alternate embodiment, the macro shift in the field of view is created by switching off the image or foreground by interrupting the video input to the monitor. This is achieved by a timing circuit as illustrated in FIG. 2 wherein means 23 represents a switching means controlling the video input to the monitor.

Figure 4:
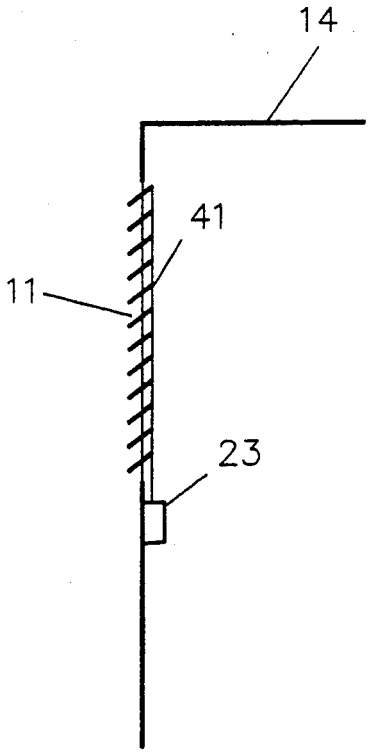
FIG. 4 is a cutaway view of a louvered exhaust vent on a force ventilated electronic components housing.

In further embodiments of the invention, a pressure wave is directed toward the face of the terminal operator as a macro event to cause the involuntary blink stimulus or with reduced force to function as a micro stimulus cue. The pressure wave may be created by a blast of air emanating from an area immediately in front of the operator's face such as the duct 11 in front of the terminal case 14. In this embodiment, the case is pressurized by a cooling fan. The duct is normally closed by an electromagnetically operated series of shutters similar to the focal plane shutter of a camera. Upon receiving a pulse from the timer 20 of FIG. 2, electromagnetic means 23 opens the louvers 41 of FIG. 4 which allows the cooling air normally circulating within the equipment case to escape in a direction calculated to cause the blast of air to strike the operator's face. After a brief instant, the shutters are closed until the next pulse which stimulates another blink. Ideally, the air source is off to one side but in front of the operator so that glasses being worn by the operator will not interfere with the short pulse of air.

Figure 3:
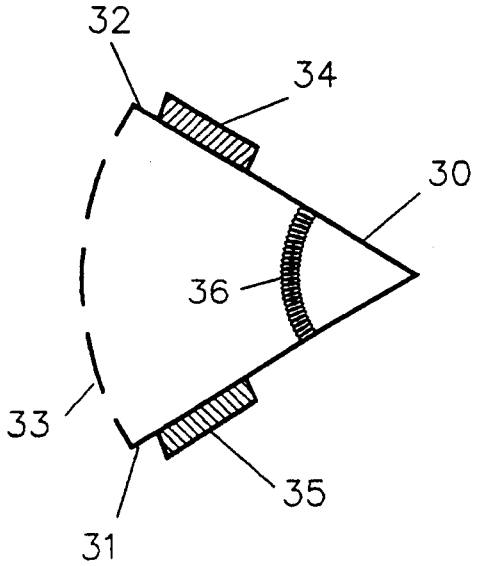
FIG. 3 is a side view of an electromagnetically controlled bellows.

In a further modification of this embodiment, a bellows like pouch is electromagnetically closed by the pulses produced by timing means 20 of FIG. 2. The bellows, 30 of FIG. 3, is flat, closed at one end and opened at the other. It is positioned so that when snapped shut, air is forced out of the open end 33 as a brief blast or pulse of a volume calculated to cause reflex blinking of the operator. A typical location is 12 of FIG. 1. The device is a simple closed pouch having an accordian-like shape wherein the top and bottom members 31 and 32 are closed at one end and both sides and open at end 33. Magnetically responsive members 34 and 35 are positioned on opposite sides of the pouch so that when at least one is stimulated by an electric current causing it to become an electromagnet, the pouch is slammed shut, forcing all the air within the pouch to be expelled. The pouch is normally held open by magnetic force or a spring means 36.

In a still further embodiment of the invention, a sonic transducer is positioned in front of the operator, typically on the top of the display means as indicated by transducer 12 in FIG. 1. In operation, a pulse from the timer 20 of FIG. 2 is applied to the stimulus 23 which may be an audible or sub-audible sonic transducer 12 which creates a brief sound wave pulse calculated to apply enough pressure to the terminal operator's face and eyes as to stimulate the reflex blink reaction when used as a macro event. The pressure wave is reduced in force when used as a micro stimulus cue.

Figure 6:
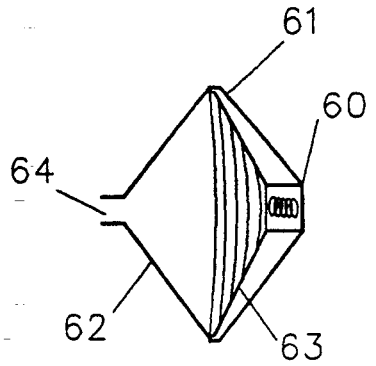
FIG. 6 is a cutaway view of a speaker fitted with a vortex generator for creating air puffs.

In another version of the invention using a sonic transducer, the transducer is a diaphragm style speaker 60, see FIG. 6, contained within a housing 61 and covered by a vortex generating cap 62. A single pulse drives the speaker cone 63 through one flexation to cause a puff of air to be directional forced out of the orifice 64 of the vortex generating cap 62.

In other embodiments of the invention, a flash or strobe light, 15 and 16 of FIG. 1, is positioned on the monitor and/or terminal case 14. The lights are controlled by the circuitry of FIG. 2 and serve as macro or micro events as a function of the candle power used. In a preferred application of this embodiment, the light source 16 on the terminal case 14 is a strobe light which provides macro effects by stimulating an unconditioned blink response and light source 15 is an LED providing a subdued light of a selected color. Alternately, both lights may be located on the monitor.

In a preferred application of the above version, a light conducting and radiating means is adjacent to the screen of the computer terminal monitor. It may be in the form of a bar across the top of the monitor or a frame 17 bordering the monitor screen to provide a subdued micro stimulus cue illumination with a clear window 18 in the frame to provide macro effect illumination until conditioning is achieved. When conditioning is achieved, the window is covered with a diffusing patch 19. In another application of this version, the light conducting frame 17 provides a macro effect illumination and a colored filter replaces patch 18 until conditioning is achieved. Then the illuminated frame is replace by an LED radiating the same color light as the filter.

Figure 5:
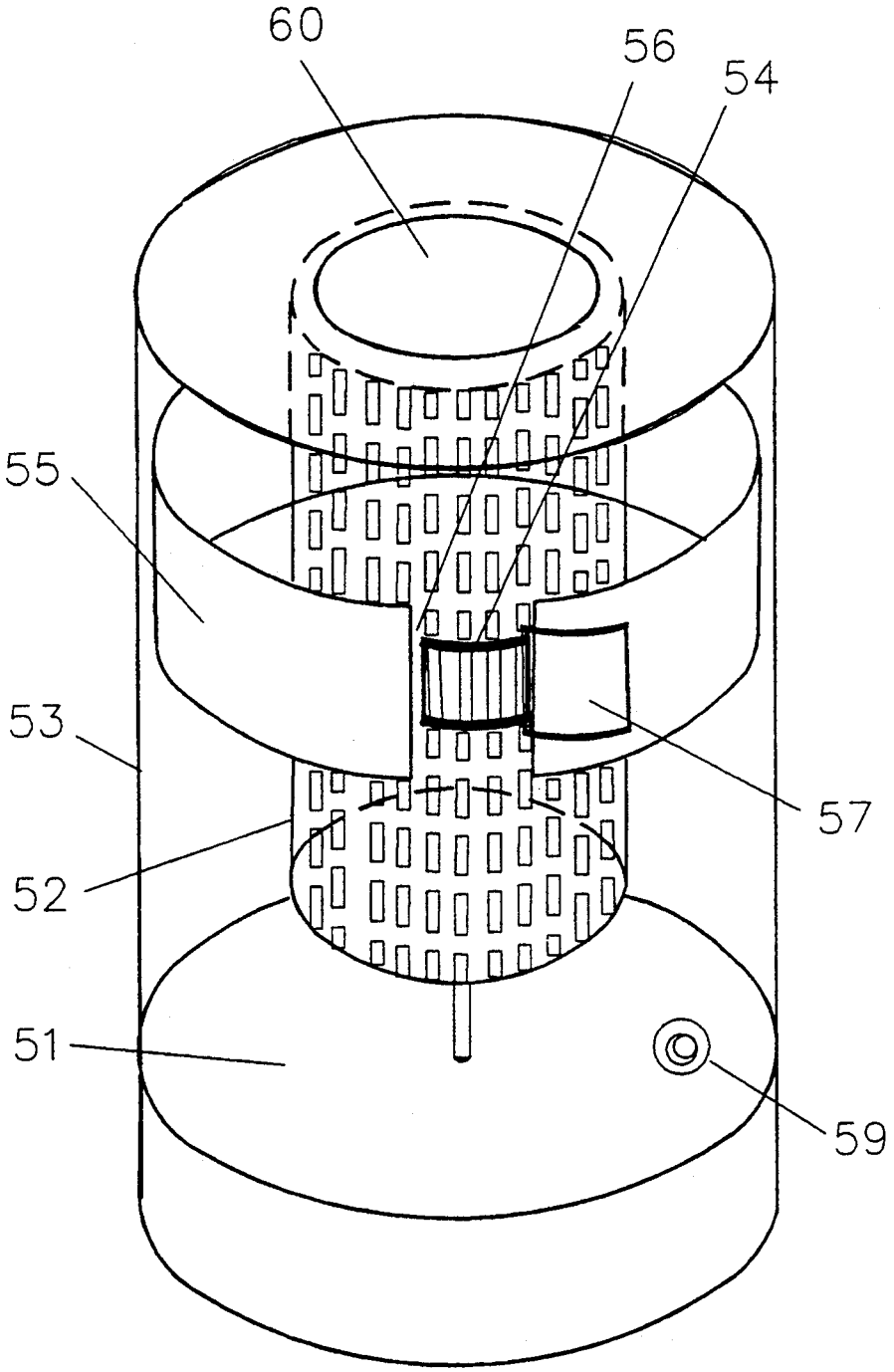
FIG. 5 is a cutaway view of an air compressor/light strobe device for producing micro and macro stimulus.

An embodiment of the invention requiring no special timing means or program embedment in illustrated in FIG. 5. An electric motor 51 drives a centrifugal squirrel cage blower 52 within a circular drum shaped housing 53. When operating, the blower draws air into the housing through openings in the bottom of the structure to cool the motor and build up a low pressure source of compressed air within the drum 53. A window 54 is the only exit for the compressed air within the drum.

A rim shaped shutter 55 is dimensioned to fit within the drum and block the window 54. It is rotated by a mechanical connection to impeller 52 or suitable driving gear means coupled to the motor drive shaft. One or more open segments or windows 56 are located in the shutter so that as the shutter rotates, the openings 56 become aligned with the drum window 54 to allow the compressed air to escape as short bursts or puffs of air. An adjustable shutter 57 is provided to control the effective opening of the drum window 54.

A light 59 is located within the drum shaped housing 53. It is positioned so that it's radiation will be reflected by the blades of the impeller 52 and out the drum window 54 every time an opening 56 is in alignment therewith. The radiation emitted by the drum window has a stroboscopic effect due to the reflection by the impeller blades as they rotate past the aligned openings. This effect is increased by driving the impeller at a higher rotational speed than the rotating shutter.

In a preferred version of this embodiment, the force of the air is slight and it provide the micro stimulus cue. The strobing or flashing light radiating from the drum window provides the macro event for stimulating an unconditioned blink response. The effects of both the air and light may be controlled by the shutter 57. When the operator is conditioned to blink in response to the air cue, the light is turned off. As conditioning improves, the amount of air in each puff is reduced by closing the drum shutter 57. Eventually the drum shutter is completely closed and the operator is conditioned to blink when facing the operating monitor without a stimulus cue.

In an alternate version of the above described system, the air is the macro event and the light is of low candle power to serve as the micro stimulus cue. In this version, a controllable exhaust opening 60 is located in the top of the drum 53 to permit a gradual reduction of air pressure without affecting the shutter rotation and micro stimulus cue. In a further modification of the version, the light 59 is replaced by an olfactory stimulating means in the form of a unique odor which may be created by an electrically heated scent source or a source such as a perfume which provides an odor under normal ambient conditions.

While preferred embodiments of this invention have been illustrated and described, variations and modifications may be apparent to those skilled in the art. Therefore, I do not wish to be limited thereto and ask that the scope and breadth of this invention be determined from the Claims which follow rather than the above description.

What is claimed is:

1. A method for reducing the eye irritation in video terminal users, including the steps of:

periodically stimulating the involuntary reflex blinking response of a person observing the display of a video terminal monitor with a conditioning stimulus;

said conditioning stimulus selected from the group comprising visual, audible, sub-audible, olfactory or tactile stimuli which cause the involuntary reflex blinking of said person; and providing said user with cue stimuli synchronously with said steps of stimulating said involuntary reflex blinking response, said cue stimuli selected from the group comprising visual, audible, sub-audible, olfactory, or tactile stimuli generated at a level of intensity which will not cause the involuntary reflex blinking of said person when said person is in a preconditioned state.

2. A method as defined in claim 1, including the further steps of reducing the magnitude of said conditioning stimulus as said user becomes conditioned to blink in response to said cue stimuli.

3. A method as defined in claim 1, including the further steps of reducing the duration of said conditioning stimulus as said user becomes conditioned to blink in response to said cue stimuli.

4. A method as defined in claim 1, including the further steps of eliminating said steps of stimulating said involuntary reflex blinking response with said conditioning stimulus when said user becomes conditioned to blink in response to said cue stimuli.

5. A method as defined in claim 1, including the further steps of repeating the generation of said conditioning stimulus and said cue stimuli at a repetition rate set by a control means.

6. A method as defined in claim 1 wherein said conditioning stimulus is sustained over a period of time which renders it discernible by said person.

7. A method as defined in claim 1 wherein said conditioning stimulus is sustained over a period of time which is so short that it is not discernible by said person.

8. A method as defined in claim 1 wherein said conditioning stimulus is sustained for a period of time which causes it to be subliminal.

9. A method as defined in claim 1 wherein said conditioning stimulus comprises an image reversal of said display.

10. A method as defined in claim 1 wherein said conditioning stimulus comprises a color shift of the background of said display.

11. A method as defined in claim 1 wherein said conditioning stimulus comprises a color shift of the foreground of said display.

12. A method as defined in claim 1 wherein said conditioning stimulus comprises defocusing of the foreground image on said display to the extent that it creates a macro reduction in the background of said display.

13. A method as defined in claim 1 wherein said conditioning stimulus is a puff of air directed at the person's face.

14. A method as defined in claim 13 wherein said cue stimuli is an olfactory stimulation.

15. A method as defined in claim 1 wherein said conditioning stimulus is a beam of visible radiation.

16. A method as defined in claim 1 wherein said conditioning stimulus is a sonic pulse.

17. A method as defined in claim 1 wherein said conditioning stimulus is a sub-audible sonic pulse.

18. A method as defined in claim 1 wherein said cue stimuli is sustained over a period of time which renders it discernible by said person.

19. A method as defined in claim 1 wherein said cue stimuli is sustained over a period of time which is so short that it is not discernible by said person.

20. A method as defined in claim 1 wherein said cue stimuli is sustained for a period of time which causes it to be subliminal.

21. A method as defined in claim 1 wherein said cue stimulus comprises a change of cursor style presented by said display.

22. A method as defined in claim 1 wherein said cue stimuli comprises a temporary color shift of characters typed during the duration of said cue stimuli.

23. A method as defined in claim 1 wherein said cue stimuli comprises a temporary color shift of the foreground of characters typed during the duration of said cue stimuli.

24. A method as defined in claim 1 wherein said cue stimuli comprises a temporary intensity shift of the characters typed during the duration of said cue stimuli.

25. A method as defined in claim 1 wherein said cue stimuli is a puff of air directed at the person's face.

26. A method as defined in claim 1 wherein said cue stimuli is a beam of visible radiation.

27. A method as defined in claim 1 wherein said cue stimuli is a sonic pulse.

28. A method as defined in claim 1 wherein said cue stimuli is a sub-audible sonic pulse.

29. A method as defined in claim 1 wherein said cue stimuli is an olfactory stimulation.

30. An apparatus for stimulating the involuntary reflex blinking of an individual observing a computer terminal monitor, comprising:

means for generating a control signal;

means responsive to said control signal for creating a conditioning stimulus directed at said individual, said conditioning stimulus selected from the group comprising visual, sub-audible, audible, or tactile stimuli which cause the involuntary blink of said individual; and means responsive to said control signal for creating a cue stimulus directed at said individual, said cue stimulus selected from the group comprising visual, sub-audible, audible, or tactile stimuli generated at a level which will not cause the involuntary blink of said individual unless said individual has been preconditioned to respond to said cue stimulus.

31. An apparatus as defined in claim 30 wherein the control signal created by said means for generating a control signal comprises a first component which initiates said conditioning and cue stimuli and a second component which terminates said conditioning and cue stimuli.

32. An apparatus as defined in claim 31 wherein the time duration between said first component and said second component is adjustable.

33. An apparatus as defined in claim 32 wherein said means for generating said control signal produces a series of said control signals with each of said control signals spaced in time an adjustable duration from the proceeding one of said control signals.

34. An apparatus as defined in claim 30 wherein said means responsive to said control signal for creating said conditioning stimulus comprises:

means for switching a video reversal circuit of said monitor.

35. An apparatus as defined in claim 30 wherein said means responsive to said control signal for creating said conditioning stimulus comprises:

an exhaust opening in a component of said terminal which is pressurized by a cooling fan;

a louvered closure for said exhaust opening; and electromagnetic means for opening and closing said louvered closure in response to said control signal.

36. An apparatus as defined in claim 30 wherein said means responsive to said control signal for creating said conditioning stimulus comprises a transducer for creating a sub-audible sound wave.

37. An apparatus as defined in claim 30 wherein said means responsive to said control signal for creating said conditioning stimulus comprises a transducer for creating an audible sound wave.

38. An apparatus as defined in claim 30 wherein said means responsive to said control signal for creating said conditioning stimulus comprises circuit means for changing the voltage of the focus control means of said monitor.

39. An apparatus as defined in claim 30 wherein said means responsive to said control signal for creating said conditioning stimulus comprises:

a bellows normally biased open; and electromagnetic means responsive to said control signal for collapsing said bellows whereby a quantity of air is ejected from said bellows toward said individual.

40. An apparatus as defined in claim 30 wherein said means responsive to said control signal for creating said conditioning stimulus comprises switching means for interrupting the video input to said monitor.

41. An apparatus as defined in claim 30 wherein said means responsive to said control signal for creating said cue stimulus comprises means for switching the style of the cursor displayed on said monitor.

42. An apparatus as defined in claim 30 wherein said means responsive to said control signal for creating said cue stimulus comprises:

an exhaust opening in a component of said terminal which is pressurized by a cooling fan;

a louvered closure for said exhaust opening; and electromagnetic means for opening and closing said louvered closure in response to said control signal.

43. An apparatus as defined in claim 30 wherein said means responsive to said control signal for creating said cue stimulus comprises a transducer for creating a subaudible sound wave.

44. An apparatus as defined in claim 30 wherein said means responsive to said control signal for creating said cue stimulus comprises a transducer for creating an audible sound wave.

45. An apparatus as defined in claim 30 wherein said means responsive to said control signal for creating said cue stimulus comprises means for vibrating a system component in contact with said individual observing the computer terminal monitor.

46. An apparatus as defined in claim 30 wherein said means responsive to said control signal for creating said cue stimulus comprises means for generating an olfactory stimulant.

47. An apparatus as defined in claim 30 wherein said means responsive to said control signal for creating said cue stimulus comprises:

a bellows normally biased open; and electromagnetic means responsive to said control signal for collapsing said bellows whereby a quantity of air is ejected from said bellows toward said individual.

48. An apparatus as defined in claim 30 wherein said means responsive to said control signal for creating said conditioning and cue stimuli comprises a light conducting and radiating means adjacent to the screen of said computer terminal monitor, said light conducting and radiating means including an area for radiating a low intensity light as said cue stimulus and an area for radiating a high intensity light as said conditioning stimulus.

49. An apparatus as defined in claim 48 wherein said area for radiating a low intensity light is created by a light filter covering a section of said light conducting and radiating means.

50. An apparatus as defined in claim 48 wherein said area for radiating a high intensity light is created by a clear section of said light conducting and radiating means.

51. An apparatus as defined in claim 30 wherein said means responsive to said control signal for creating said conditioning and cue stimuli comprises:

an air compressor including an impeller, a motor driving said impeller, and a circular housing enclosing said impeller and forming a container for air compressed by said impeller;

a window in said circular housing;

means for generating an olfactory stimulant within said circular housing;

a rotating shutter driven by said motor, said rotating shutter dimensioned and positioned to close said window;

an opening in said rotating shutter dimensioned and positioned to become aligned with said window periodically as said rotating shutter rotates for allowing air compressed in said circular housing to escape through said window as one of said stimuli and the odor generated by said means for generating an olfactory stimulant to be carried by said escaping air as the other of said stimuli.

52. An apparatus as defined in claim 30 wherein said means responsive to said control signal for creating said conditioning and cue stimuli comprises:

an air compressor including an impeller, a motor driving said impeller, and a circular housing enclosing said impeller and forming a container for air compressed by said impeller;

a window in said circular housing;

a source of visible light radiation;

a rotating shutter driven by said motor, said rotating shutter dimensioned and positioned to close said window;

an opening in said rotating shutter dimensioned and positioned to become aligned with said window periodically as said rotating shutter rotates for allowing air compressed in said circular housing to escape through said window as one of said stimuli and light generated by said source of visible light radiation to radiate there from as the other of said stimuli.

53. An apparatus as defined in claim 52, comprising a closure for regulating the effective opening of said window.

54. An apparatus as defined in claim 52, comprising a closure for regulating the effectiveness of said compressor.

55. An apparatus as defined in claim 52 wherein said source of visible light radiation is positioned so that light generated thereby is reflected through said window by the blades of said impeller.

56. An apparatus as defined in claim 52 wherein said air compressed in said circular housing which escapes through said window comprises said conditioning stimulus and said visible light radiation which radiates through said window comprises said cue stimulus.

57. An apparatus as defined in claim 52 wherein said air compressed in said circular housing which escapes through said window comprises said cue stimulus and said visible light radiation which radiates through said window comprises said conditioning stimulus.

58. An apparatus as defined in claim 30 wherein said means responsive to said control signal for creating said conditioning stimulus comprises:

an audio speaker including a speaker cone of the type which displaces air in response to an electrical pulse;

said control signal comprises a series of single pulses causing single flexations of said speaker cone; and a vortex generating orifice for directing said displaced air.

59. An apparatus as defined in claim 30 wherein said means responsive to said control signal for creating said cue stimulus comprises:

an audio speaker including a speaker cone of the type which displaces air in response to an electrical pulse;

said control signal comprises a series of single pulses causing single flexations of said speaker cone; and a vortex generating orifice for directing said displaced air.

60. A method for conditioning a person to blink periodically when observing a computer terminal monitor to reduce eye fatigue, including the steps of:

periodically changing the screen attributes of said monitor for a predetermined time period to effect a change in the output of said monitor which is of a magnitude that will cause an involuntary blink reaction in said person;

providing a cue stimulus synchronously with said steps of periodically changing the screen attributes of said monitor, said cue stimulus selected from the group comprising visual, audible, sub-audible, or tactile stimuli generated at a level of intensity which will not cause the involuntary reflex blinking of said person when said person is in a preconditioned state; and stopping said periodical changes of screen attributes while maintaining said cue stimulus at said periodical rate when said person is conditioned to blink in response to said cue stimulus.

61. A method as defined in claim 60, including the further steps of:

discontinuing said cue stimulus when said person is conditioned to blink at said periodical rate when seated before said computer terminal monitor without being subjected to said conditioning stimulus or said cue stimulus.

62. A method as defined in claim 60 wherein said step of changing said screen attributes switches the display of said monitor from light foreground and dark background to dark foreground and light background.

63. A method as defined in claim 60 wherein said step of changing said screen attributes switches the display of said monitor from dark foreground and light background to light foreground and dark background.

64. A method as defined in claim 60 wherein said step of changing said screen attributes switches the display of said monitor from white foreground and black background to black foreground and white background.

65. A method as defined in claim 60 wherein said step of changing said screen attributes switches the display of said monitor from black foreground and white background to white foreground and black background.

66. A method as defined in claim 60 wherein said step of changing said screen attributes changes the background color of the display of said monitor.

67. A method as defined in claim 60 wherein said step of changing said screen attributes changes the foreground color of the display of said monitor.

68. A method as defined in claim 60 wherein said cue stimulus is sustained over a period of time which renders it discernible by said person.

69. A method as defined in claim 60 wherein said cue stimulus is sustained over a period of time which is so short that it is not discernible by said person.

70. A method as defined in claim 60 wherein said cue stimulus is sustained for a period of time which causes it to be subliminal.

71. A method as defined in claim 60 wherein said cue stimulus comprises a change of cursor style presented by said monitor.

72. A method as defined in claim 60 wherein said cue stimulus comprises a temporary color shift of characters typed during the duration of said cue stimulus.

73. A method as defined in claim 60 wherein said cue stimulus comprises a temporary color shift of the foreground of characters typed during the duration of said cue stimulus.

74. A method as defined in claim 60 wherein said cue stimulus comprises a temporary intensity shift of the characters typed during the duration of said cue stimulus.

75. A method as defined in claim 60 wherein said cue stimulus is a puff of air directed at said person's face.

76. A method as defined in claim 60 wherein said cue stimulus is a beam of visible radiation.

77. A method as defined in claim 60 wherein said cue stimulus is a sonic pulse.

78. A method as defined in claim 60 wherein said cue stimulus is a sub-audible sonic pulse.

79. A method as defined in claim 60 wherein said cue stimulus is an olfactory stimulation.

* * * * *